US007017199B2

(12) United States Patent
Oropallo et al.

(10) Patent No.: US 7,017,199 B2
(45) Date of Patent: Mar. 28, 2006

(54) PLUMBING FITTING COVER CAP RETENTION

(76) Inventors: Robert A. Oropallo, 1560 Kensington Rd., San Marino, CA (US) 91108; Anthony Oropallo, Jr., 1146 Altura Ter., Arcadia, CA (US) 91007

( * ) Notice: Subject to any disclaimer, the term of this patent is extended or adjusted under 35 U.S.C. 154(b) by 15 days.

(21) Appl. No.: 10/407,593

(22) Filed: Apr. 7, 2003

(65) Prior Publication Data

US 2003/0192115 A1 Oct. 16, 2003

Related U.S. Application Data

(63) Continuation-in-part of application No. 10/112,844, filed on Mar. 28, 2002, now Pat. No. 6,618,875.

(51) Int. Cl.
*E03C 1/244* (2006.01)

(52) U.S. Cl. ..... 4/694

(58) Field of Classification Search ..... 4/680, 4/694

See application file for complete search history.

(56) References Cited

U.S. PATENT DOCUMENTS

| | | | | |
|---|---|---|---|---|
| 5,025,509 | A | 6/1991 | Holt et al. | |
| 6,192,531 | B1 | 2/2001 | Fritz et al. | |
| 2002/0032926 | A1 * | 3/2002 | Lewis | 4/680 |

* cited by examiner

*Primary Examiner*—Charles E. Phillips
(74) *Attorney, Agent, or Firm*—William W. Haefliger

(57) ABSTRACT

A plumbing fitting attachable to a wall that defines an opening, comprising a tubular part sized to project through an opening, there being grooving associated with the part; a cover extending in registration with the grooving; and a retainer caused by the cover and projecting to locally engage the grooving, thereby to position the cover in relation to the grooving.

10 Claims, 7 Drawing Sheets

11
13
2
15
10
2
50
16
18
19
17
20

3
10a
25
23
24
13
30
27
50
25
10
21
3

FIG. 10.
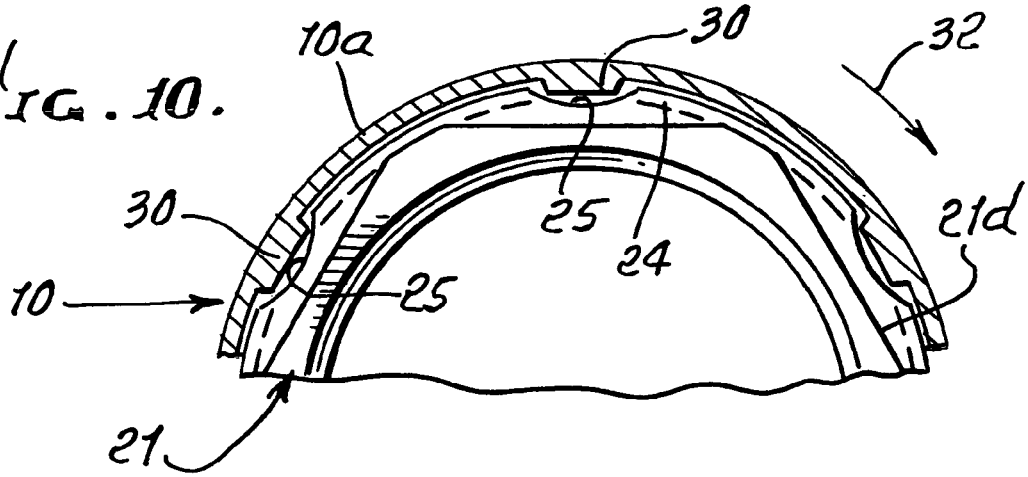
FIG. 11.
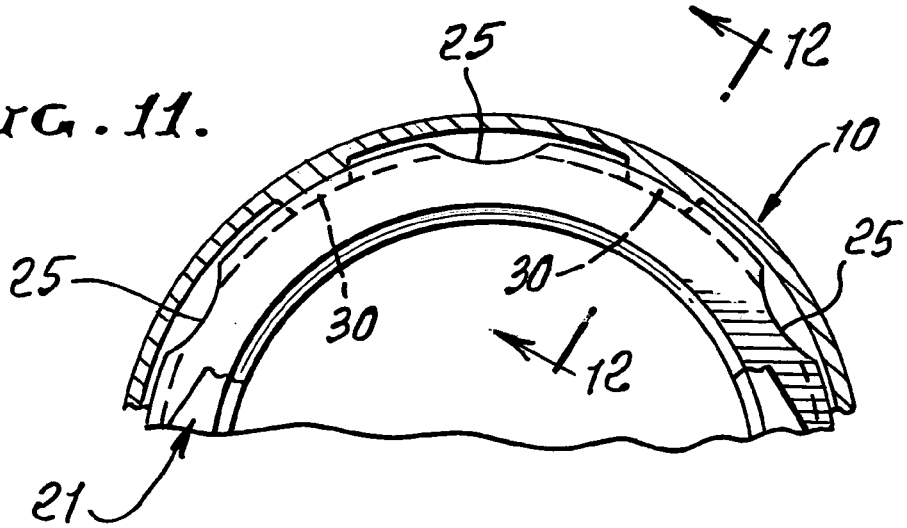
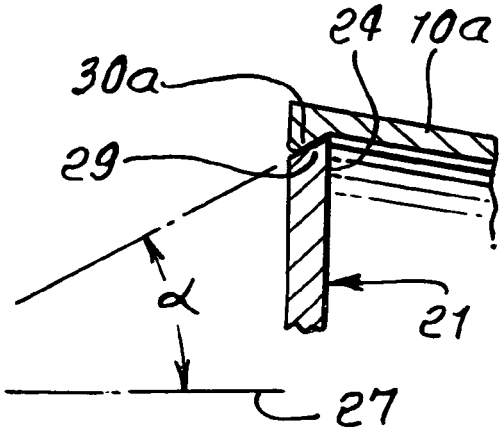
FIG. 12.

PLUMBING FITTING COVER CAP RETENTION

This application is a continuation-in-part of prior U.S. application Ser. No. 10/112,844, filed Mar. 28, 2002 now U.S. Pat. No. 6,618,875.

BACKGROUND OF THE INVENTION

This invention relates generally to bath waste plumbing equipment, and more particularly retention of waste water outlet covers to terminals or outlets of plumbing fittings, as well as provision and use of caps for pressure testing of plumbing lines leading to such outlets.

There is continual need for improvements in such bath waste plumbing equipment, facilitating ease of application of such outlet covers to plumbing terminals as at bath or shower walls and removal of such covers; and there is need for equipment facilitating pressure testing of such plumbing lines leading to such terminals. No prior equipment of which we are aware incorporates the novel and highly useful cover and mounting structure of the present invention, or its functioning and improved results obtained. Also, no prior equipment of which we are aware incorporates the cover holding structure as will appear.

SUMMARY OF THE INVENTION

It is a major object of the invention to provide highly useful improvements in plumbing equipment as referred to above. Basically, the invention is incorporated in a retention and/or positioning system or apparatus for a tubular terminal cover, the tubular terminal being a part of a plumbing fitting. Such a tubular terminal or part projects through an opening in a wall, and typically defines grooving such as threading. One aspect of the invention comprises a) a cover extending in registration with such grooving, b) and a retainer carried by the cover and projecting to locally engage such grooving, thereby to position the cover in relation to the grooving.

The cover is typically positioned to resist inadvertent rotation and/or loosening.

It is another object to provide for ease of manipulation of the retainer (as for example into or out of operating position). this may be facilitated by providing a slot in the cover, a bridge extending across the slot, and the retainer carried by the bridge to project toward and to penetrate a local portion of the grooving, such a threading, on the tubular terminal.

It is another object to provide the bridge to extend in the plane of the slot, or offset relative to that plane, to diminish easy access to the retainer in the form of a set screw, thereby to prevent inadvertent access to and loosening of the set screw, as for example during cleaning of such plumbing.

Yet another object includes provision of retention system for holding and mounting a cover cap to a plumbing fitting having a tubular terminal that projects at an opening through a bath or shower wall, and including said cap, comprising a) a retainer ring fitting on said tubular terminal and tightenable toward said wall, b) a series of retention cams on said ring and spaced about a longitudinal axis defined by the ring, there being gaps between successive cams, and there being retention shoulders on the cams, c) said retention shoulders facing in directions toward said wall, for retaining holders on the cover cap, after said holders have been passed longitudinally through said gaps and after the cap has been then rotated to cause said holders to slidably engage the cams and become wedged against said retention shoulders, d) and a positioner carried by said cap and projecting to locally engage grooving associated with said tubular terminal.

An additional object is to provide a method of pressure testing a plumbing fitting having a tubular terminal that projects at an opening through a wall, that includes i) providing and connecting a pressure test cap to said terminal to engage an annular seal between the cap and at an end face of the tubular terminal, thereby to seal off the tubular terminal, ii) applying internal fluid pressure to the fitting to determine if any fitting leakage exists, iii) removing the pressure test cap from the terminal, iv) subsequently providing a cover cap onto the tubular terminal to allow fluid leakage through the cover cap, v) and thereafter providing and locating a positioner or holder to project through the cover cap and into local engagement with grooving associated with the tubular terminal.

In this regard, the cover cap may incorporate a water drainage slot, and an associated bridge, and the positioner may be located to extend through the bridge.

These and other objects and advantages of the invention, as well as the details of an illustrative embodiment, will be more fully understood from the following specification and drawings, in which:

DRAWING DESCRIPTION

FIG. 10 is an axial view showing forward passage of holders on the cap skirt through gaps between circularly successive cams on the retainer ring;

FIG. 11 is a view like FIG. 10, but taken after the cap has been rotated to move the holders into wedged, cap retention position;

FIG. 12 is a further enlarged fragmentary view taken on lines 12—12 of FIG. 11, to show holder wedging;

DETAILED DESCRIPTION

Figure 1:
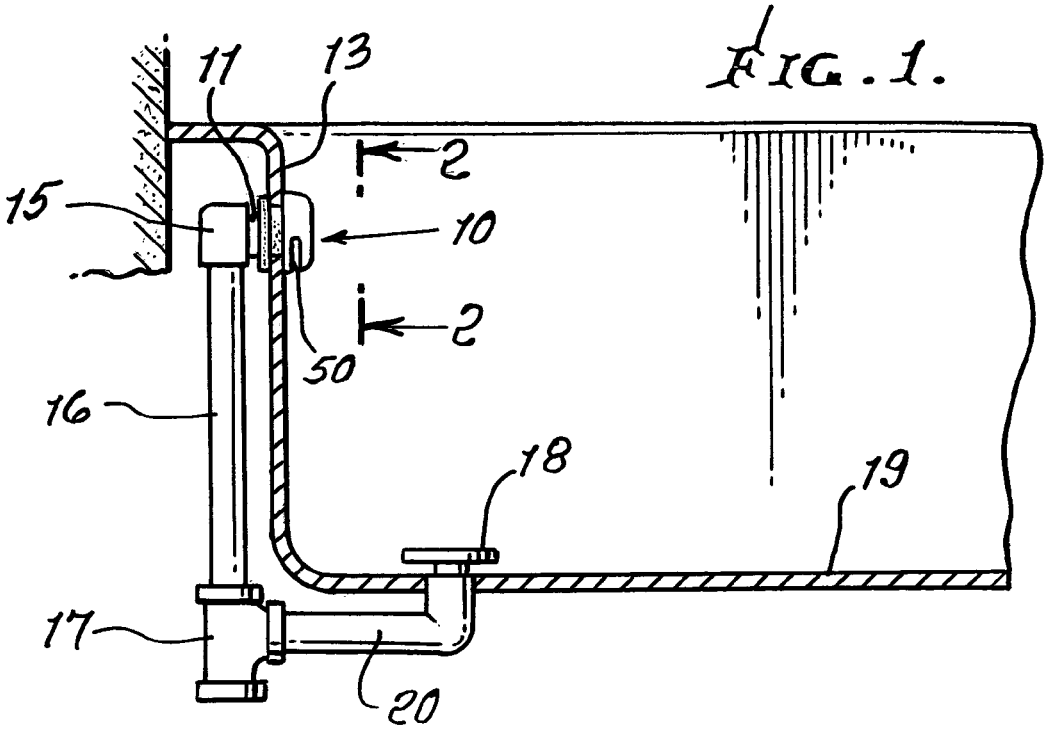
FIG. 1 is a simplified showing, in elevation, waste plumbing leading from a tub or shower wall opening.
Figure 2:
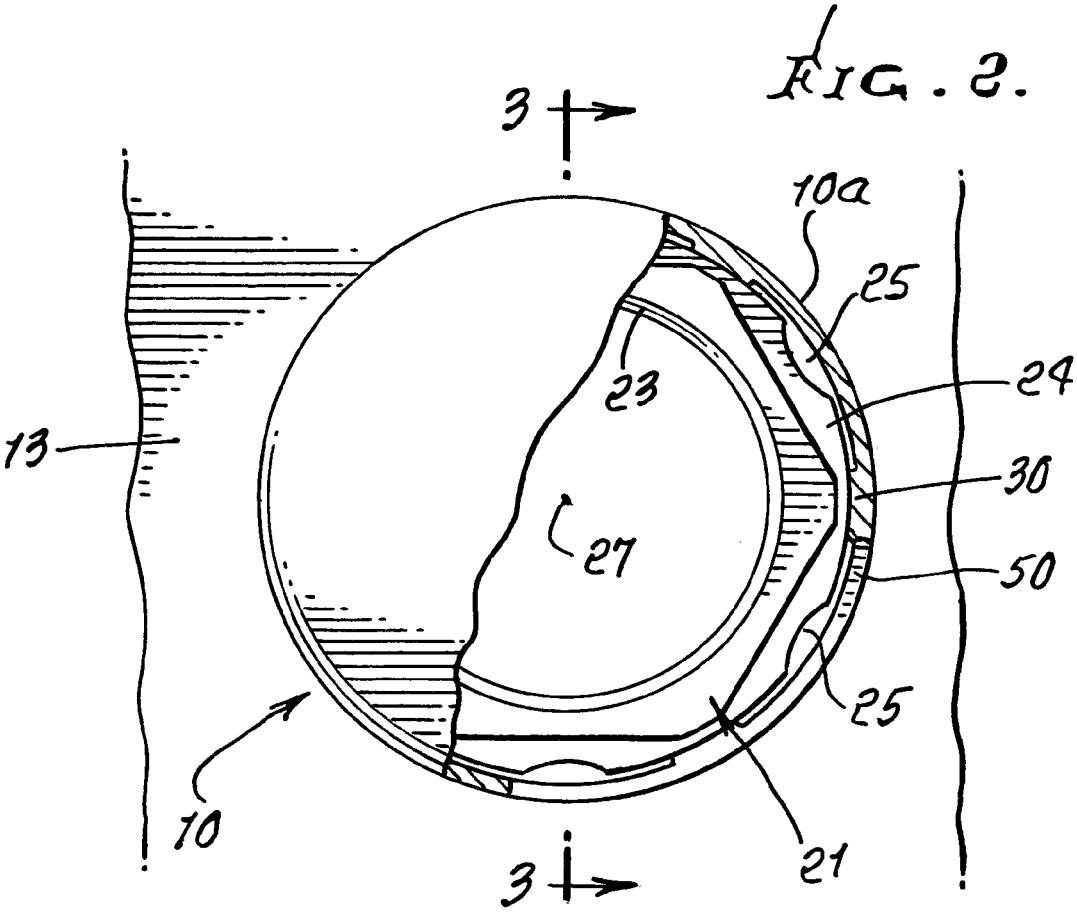
FIG. 2 is an enlarged elevation, partly broken away, and taken on lines 2—2 of FIG. 1.
Figure 3:
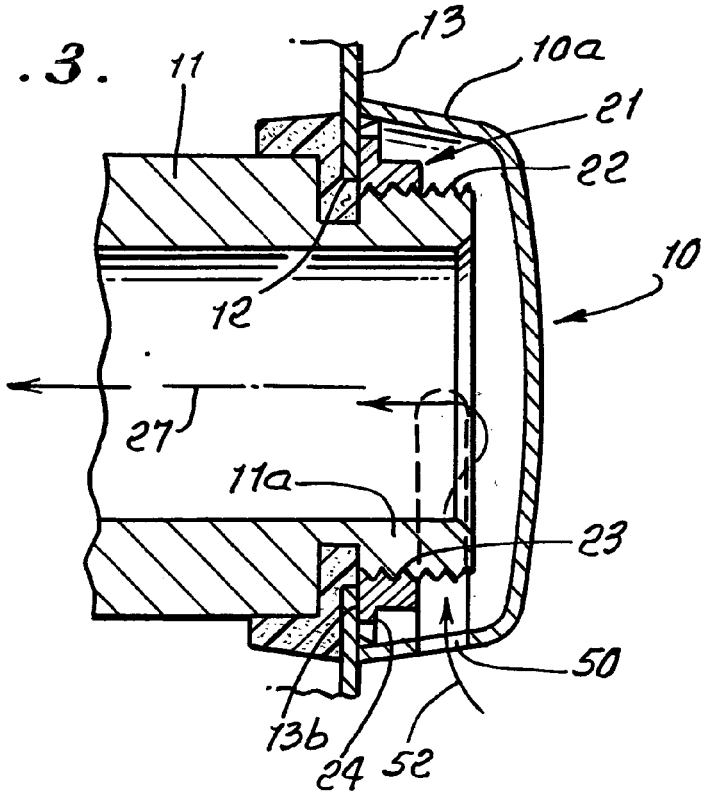
FIG. 3 is a section taken in elevation on lines 3—3 of FIG. 2.

FIGS. 1 and 3 show a cover cap 10 retained in position to cover a tubular terminal 11*a* of a plumbing line 11, projecting at or through an opening 12 in a bath or shower wall 13. A bath wall is illustrated, but is also representative of a shower wall. Merely for purposes of illustration, waste water plumbing line 11 may be connected by elbow 15 to a vertical duct 16, to which a tee 17 is connected. An outlet 18 at the tub or shower bottom wall 19 is also connected to the tee, as by waste line 20.

Figure 4:
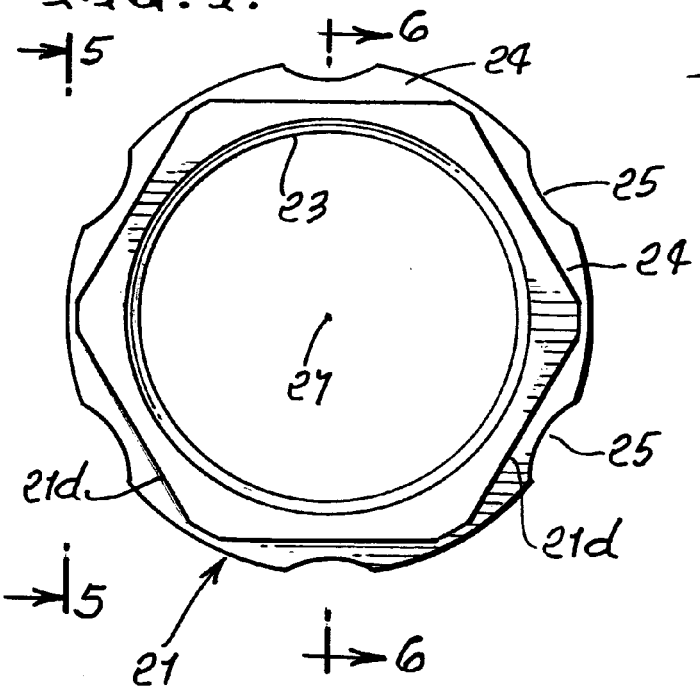
FIG. 4 is a frontal view taken in elevation, showing a retainer ring, as is also seen in section in FIG. 3.
Figure 5:
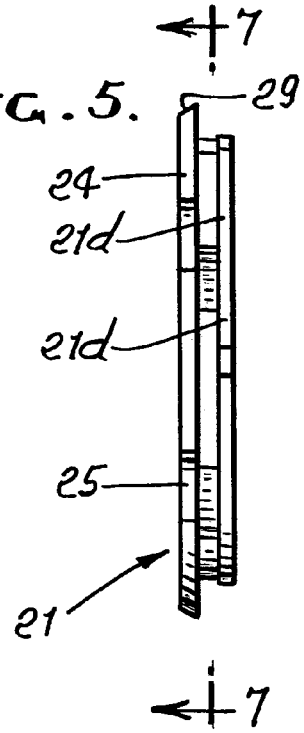
FIG. 5 is an edge elevation view taken on lines 5—5 of FIG. 4.
Figure 6:
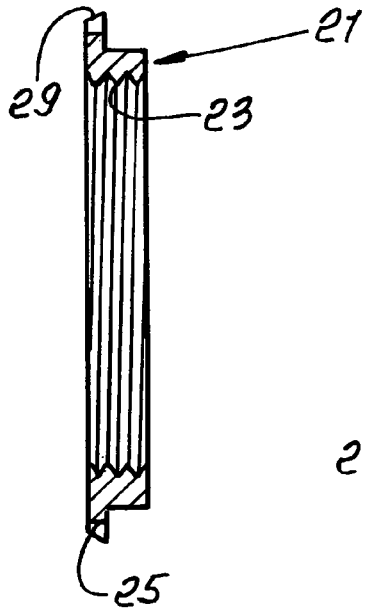
FIG. 6 is a section taken through the retainer ring, on lines 6—6 of FIG. 4.
Figure 7:
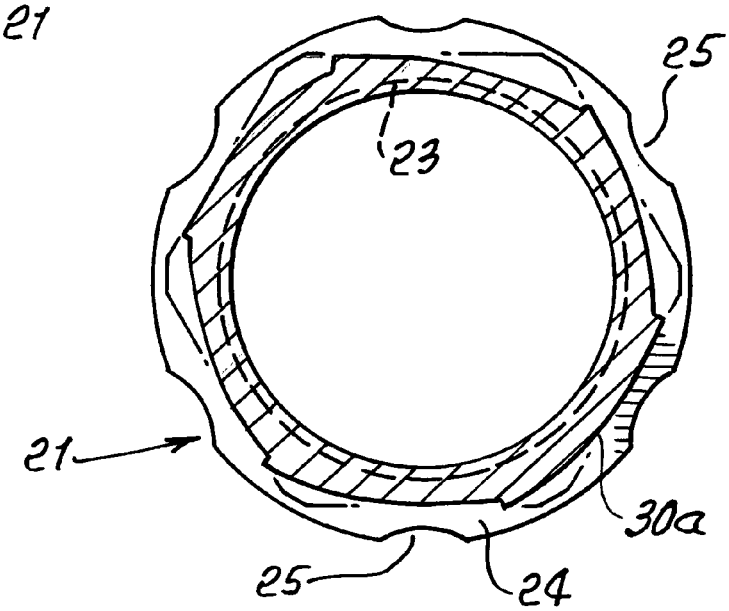
FIG. 7 is a section taken on lines 7—7 of FIG. 5 to show holder retention structure.

As shown in FIG. 3, a retainer ring 21 is fitted on terminal 11*a*. Such fitting may incorporate external threading 22 on 11*a*, and internal threading 23 on the ring, whereby the ring can be tightened toward wall 13, to frictionally position the ring adjacent the wall, as shown at 13*b*. FIG. 4 shows wrench flats 21*d* circularly spaced apart on the ring 21, and engageable by a wrench to facilitate such tightening.

In accordance with an important feature of the invention, the preferred ring 21 carries a series of like retention cams 24 spaced apart by gaps 25, and projecting outwardly at circularly spaced positions or intervals, about longitudinal axis 27 defined by the ring 21. Retention shoulders 29 are defined by the cams, at their sides which face wall 13, and are typically angled at angle $\alpha$ relative to axis 27, as seen in FIG. 12. Shoulders 29 face toward wall 13, due to such angling.

Figure 8:
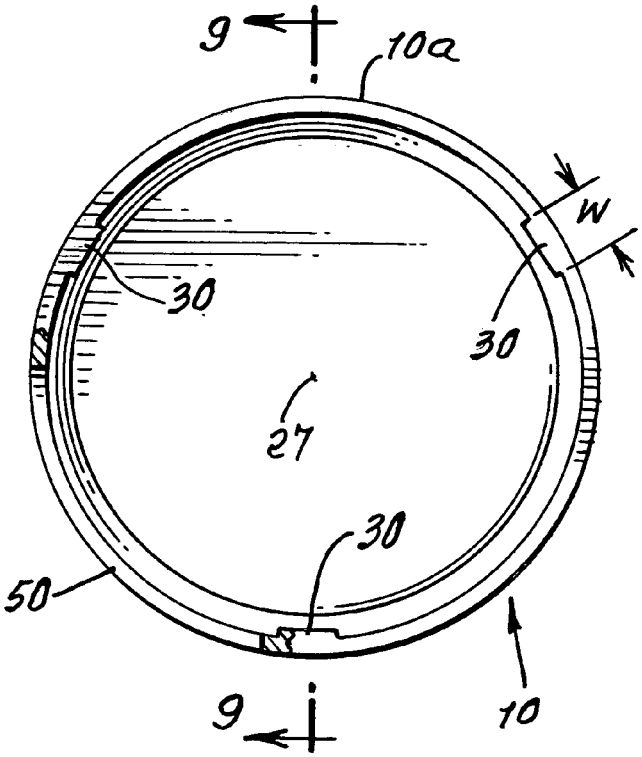
FIG. 8 is an axial elevation showing cap skirt and holder structure.
Figure 9:
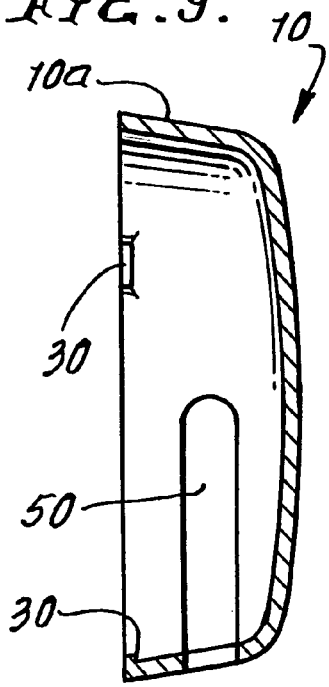
FIG. 9 is a section taken on lines 9—9 of FIG. 8.

The decorative cover cap 10, which conceals the ring 21, terminal 11*a* and threading 22 and 23, is adjustably retained to ring 21 as by a circularly spaced series of holders 30 formed on or carried by the cap skirt 10*a*. Such holders may comprise small lips, best seen in FIGS. 8 and 9, spaced circularly at angular intervals $\beta$, about axis 27. Three such lips, spaced at 0°, 120° and 240° about axis 27 are shown. Their width "$\omega$" is such as to enable their passage through the gaps 25, as shown in FIG. 10, at the time of assembly of the cover cap to the ring 21. Once having passed through such gaps, the holders are in proximate or adjacent relation to wall 13; but the clearance are such as to allow cap and holder rotation as in direction 32 in FIG. 10, to wedgingly engage the cams 24. One way to accomplish this is to configure the holder lips 30 with surfaces 30*a* angled to wedgingly engage the retention shoulders 29 of the cams, as seen in FIG. 12. The interengagement is frictionally, and may allow for continued rotation of the cap to advance the holders beyond the interengaged cams, and to bring the holders into registration with the next in sequence gaps 25, enabling axial removal of the cap 10 from the ring 21. Reverse rotation of the cap also accomplishes the same objective. Accordingly, an easily installed and easily removed decorative and protective cap is provided for, the ring 21 also being easily installed and removed, as described.

Figure 13:
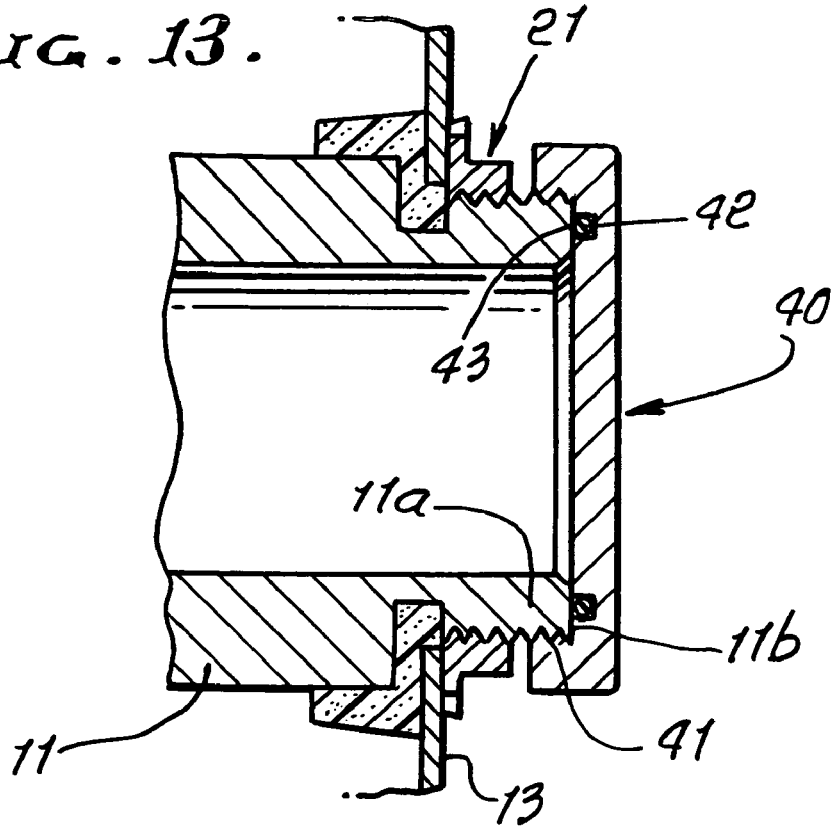
FIG. 13 is a section like FIG. 3, but showing a pressure test cap in retained and sealing position on the plumbing tubular terminal.
Figure 14:
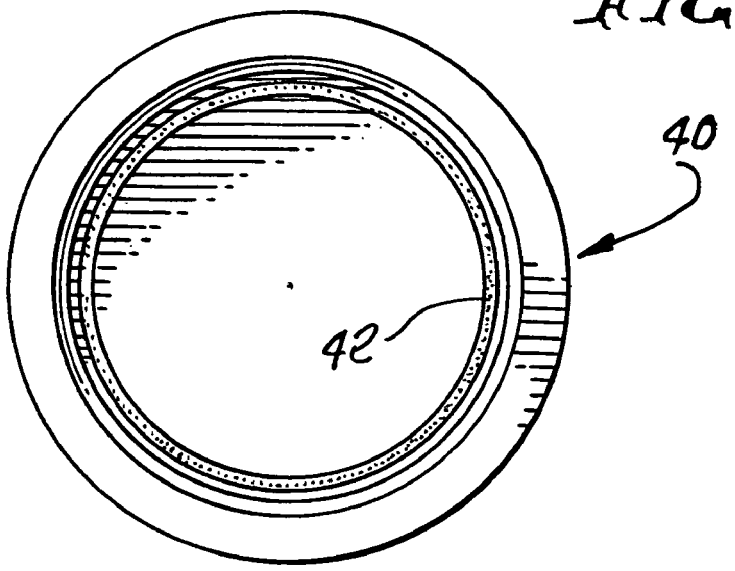
FIG. 14 is an axial view showing the seal ring carried by the pressure test cap.

FIGS. 13 and 14 show a pressure test cap 40 thread connected at 41 to the tubular terminal 11*a*, without requiring removal of ring 21. An annular seal 42 carried by that cap is brought into sealing engagement at 43 with the end face 11*b* defined by the plumbing terminal 11*a*, by tightening of the cap in the position shown. The construction allows quick removal of decorative cap 10, and quick installation of pressure test cap 40, for a testing of the plumbing for leaks.

The method of testing a plumbing fitting having a tubular terminal that projects at an opening through a wall, includes:

i) providing and rotatably connecting a pressure test cap to said terminal to engage an annular seal between the cap and on an end face of the tubular terminal, thereby to seal off said tubular terminal, ii) applying internal fluid pressure to the fitting to determine if any fitting leakage exists, iii) rotatably removing the pressure test cap from the terminal, iv) and providing and rotatably connecting a cover cap onto said tubular terminal to allow fluid leakage through the cover cap.

It will be understood, that the construction of the assembly is such as to allow associated use (application and removal) as described for both protection of the plumbing terminal, and pressure testing of the plumbing, and also for quick removal of 10 and quick installation of 40, as referred to.

A passage 50 in the skirt of 10*a* of the cap 10, allows for drainage of any water collecting in the cap, and the cap can be applied to direct passage 50 downwardly. See FIGS. 1 and 3. Air or bath water can enter via passage 50, as indicated by arrows 52.

Figure 15:
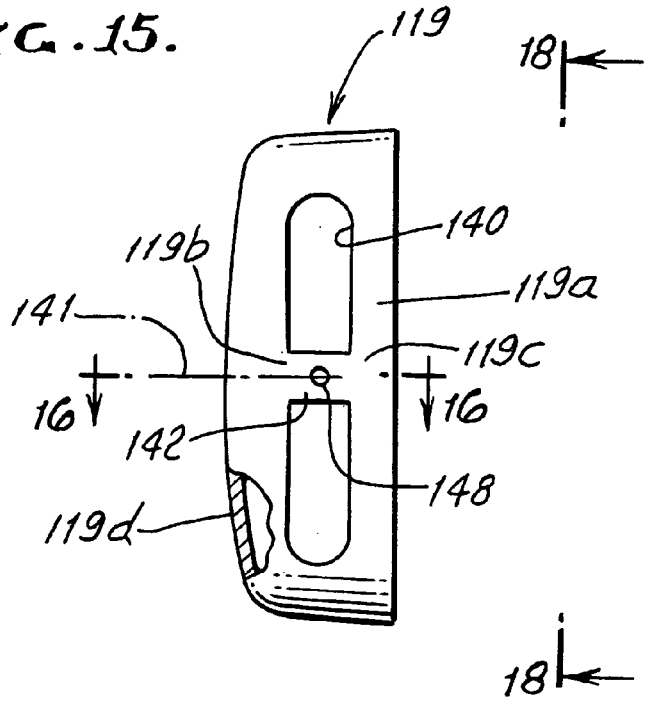
FIG. 15 is a side view of a modified cap.
Figure 16:
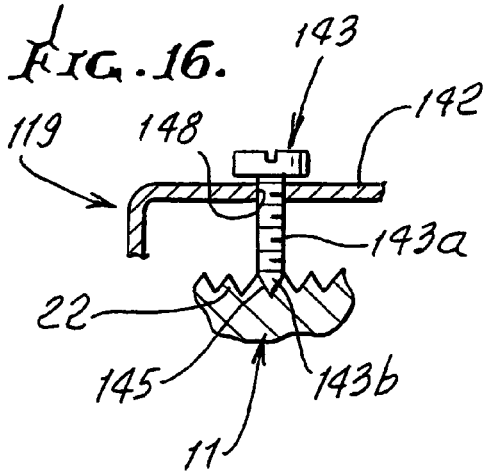
FIG. 16 is a section taken on lines 16—16 of FIG. 15, together with a set screw holding the cap against rotation.

Referring now to FIGS. 15 and 16, a modified cover up 119 is like cap 19, and serves the same functions. It has a through slot or cut-out 140 or passage cut or formed in the cap annular skirt 119*a*. Slot 140 is preferably elongated arcuately about the cap axis 141. A bridge 142 extends widthwise across the slot, and may be integral with cap skirt section 119*b* and 119*c*, as shown. The cap end wall is shown at 119*d*, and is in alignment with part 11. The bridge is located in an arcuate plane defined by the slot, or parallel to the slot.

Figure 18:
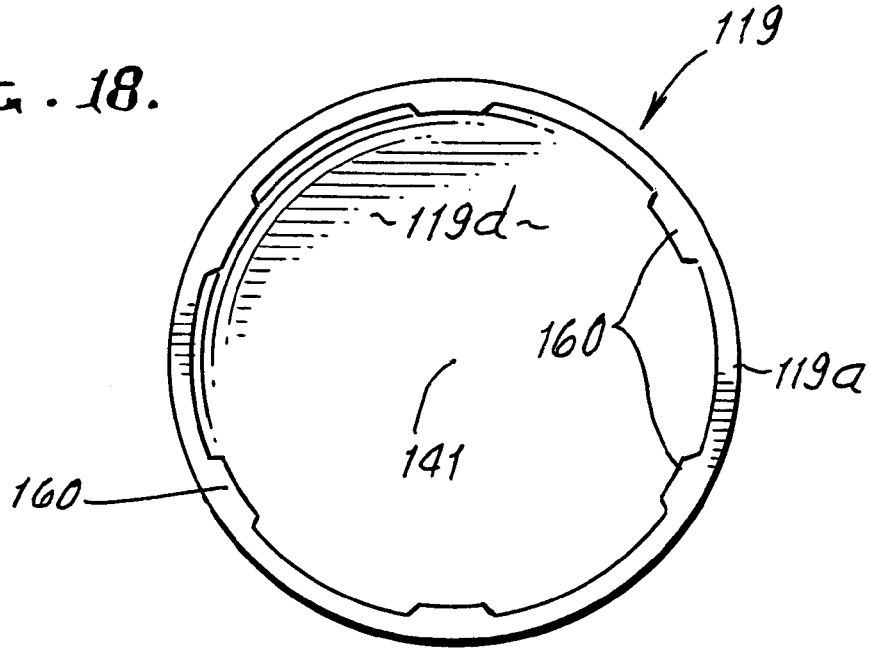
FIG. 18 is an end view taken on lines 18—18 of FIG. 15.

As shown in FIGS. 15 and 16, a threaded hole 148 formed in bridge 142 is adapted to receive a positioner, as for example a set screw 143, threadably engaging the hole threaded bore. The length of the fastener stem 143*a* is such as to allow penetration at 145 of the fastener tip 143*b* into grooving, as for example thread 22 of 11. Tightening of the set screw serves to anchor the cap against inadvertent rotation and/or re-positioning that could result in inadvertent cap removal. The cap is typically otherwise retained in position by lips 160, corresponding to lips 30 referred to above. See FIG. 18.

Figure 17:
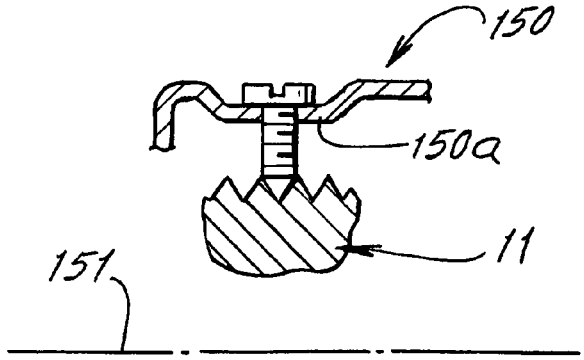
FIG. 17 is a view like FIG. 16, showing a modification.

FIG. 17 shows provision of a bridge 150 that has an intermediate wall section 150*a* that is downwardly offset toward the cap axis 151.

Figure 19:
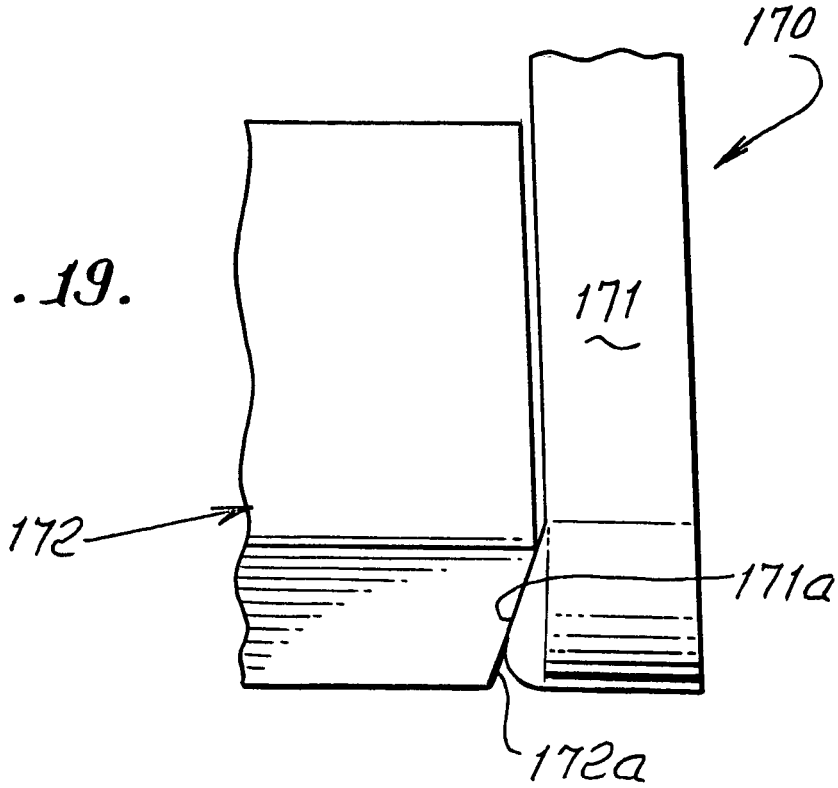
FIG. 19 is a side view showing cover engagement with a nut.

FIG. 19 shows a modified cover cap 170 having a skirt 171 with a protruding angle local edge portion 171*a*. The latter engages an angled or grooved edge 172*a* of nut 172, corresponding to nut 21. That local engagement serves to also or alternatively provide a means to resist cap inadvertent rotation.

We claim:

1. A plumbing fitting attachable to a wall that defines an opening, comprising a) a tubular part sized to project through said opening, there being grooving associated with said part, b) a cover extending about said grooving, c) and a retainer ring carried by the cover and projecting to locally engage said part, thereby to position the cover in relation to said grooving, d) and a series of retention cams on said ring and spaced about a longitudinal axis defined by the ring, there being gaps between successive cams, and there being retention shoulders on the cams, e) said retention shoulders facing in directions for retaining holders on the cover, the said holders have been passed longitudinally through said gaps, and after the cover has then been rotated, the cap engages said part to resist cap rotation.

2. The combination of claim 1 wherein said cover extends about the holders.

3. The combination of claim 1 wherein said cover comprises a cap having an end wall in alignment with said tubular part.

4. The combination of claim 1 wherein said ring has thread connection to said tubular part.

5. The combination of claim 1 including wrench flats carried by the ring and spaced axially from said cams, whereby the ring may be rotatably tightened by a wrench.

6. The combination of claim 1 wherein said cap is retained in a position of attachment to the cams, the cams received within said cap and the cap defining a fluid passing passage.

7. The combination of claim 1 wherein the cap has a skirt carrying said holders and said positioner.

8. The combination of claim 1 wherein said holders are lips at an edge of the skirt.

9. The combination of claim 1 wherein said skirt has an aperture in fluid passing communication with said passage.

10. The combination of claim 1 including a pressure test cap thread connected to said tubular terminal, and an annular seal carried by said pressure test cap in sealing engagement with an end face defined by said tubular terminal, in spaced relation to said ring.

* * * * *